US007028445B2

(12) United States Patent
Camilleri

(10) Patent No.: US 7,028,445 B2
(45) Date of Patent: Apr. 18, 2006

(54) METHOD OF CONSTRUCTING A CONCRETE SLAB

(75) Inventor: Paul Anthony Camilleri, Mermaid Beach (AU)

(73) Assignee: Evolution International No.2 Pty Ltd., Queensland (AU)

( * ) Notice: Subject to any disclaimer, the term of this patent is extended or adjusted under 35 U.S.C. 154(b) by 60 days.

(21) Appl. No.: 10/683,406

(22) Filed: Oct. 9, 2003

(65) Prior Publication Data

US 2004/0074201 A1 Apr. 22, 2004

(51) Int. Cl.
*E04B 1/00* (2006.01)
*E04G 21/00* (2006.01)

(52) U.S. Cl. ..... 52/742.19; 52/169.1; 52/169.2; 52/169.3; 52/294; 52/296; 405/302.4; 405/302.5

(58) Field of Classification Search ..... 52/742.14, 52/169.1, 169.2, 169.3, 155–163, 293–299, 52/309.4, 309.8, 405, 697, 169.11, 656, 699, 52/576, 597–599, 470, 426–428; 249/3–6, 249/215; 405/302.4, 302.5, 229–233, 234–250, 405/251–257

See application file for complete search history.

(56) References Cited

U.S. PATENT DOCUMENTS

| | | | | |
|---|---|---|---|---|
| 3,967,451 | A * | 7/1976 | Garbe | 405/57 |
| 4,011,705 | A * | 3/1977 | Vanderklaauw | 52/745.08 |
| 4,068,445 | A * | 1/1978 | Bobbitt | 52/741.11 |
| 4,275,538 | A * | 6/1981 | Bounds | 52/299 |
| 5,174,083 | A * | 12/1992 | Mussell | 52/169.1 |
| 5,194,689 | A * | 3/1993 | Cummins | 102/302 |
| 6,178,710 | B1 * | 1/2001 | Colalillo | 52/310 |
| 6,550,199 | B1 * | 4/2003 | Phillips | 52/294 |

* cited by examiner

*Primary Examiner*—Jeanette E. Chapman
(74) *Attorney, Agent, or Firm*—Abelman, Frayne & Schwab

(57) ABSTRACT

A method constructs a concrete building slab by loosening the soil on which the concrete building slab is to be constructed to at least a predetermined loosening depth so as to expand the soil upwards, driving a plurality of piles into the soil in predetermined respective locations to a predetermined founding depth, and subsequently forming a concrete slab on the loose soil to be supported by the piles.

11 Claims, 3 Drawing Sheets

METHOD OF CONSTRUCTING A CONCRETE SLAB

BACKGROUND OF THE INVENTION

1. Field of the Invention

This invention relates to a method of constructing concrete building slabs.

2. Description of the Related Art

One problem from which on-ground concrete slabs presently suffer is that they are subject to soil movement, particularly a phenomenon known as soil heave. Soil heave is due at least in part to expansion of soil particles when they become wet which results in the surface of the soil rising and applying uplifting forces to the slab resting thereon. The uplifting forces can be high enough to lift the concrete slab in places which can cause cracking of the slab and the walls which rest on the slab. Soils which have a high clay content are highly reactive to moisture levels and can cause significant damage to a building as they expand.

BRIEF SUMMARY OF THE INVENTION

One object of the present invention is to provide a method of construction which overcomes or at least ameliorates the aforementioned problem.

The invention in one aspect resides broadly in a method of constructing a concrete building slab, including:

- loosening the soil on which the concrete building slab is to be constructed to at least a predetermined loosening depth so as to expand it upwards;
- driving a plurality of piles into the soil in predetermined respective locations to a predetermined founding depth; and
- subsequently forming a concrete slab on the loose soil to be supported by the piles.

In another aspect, the invention resides broadly in a method of constructing a concrete slab, including:

- loosening the soil on which the concrete building slab is to be constructed to at least a predetermined loosening depth so as to expand it upwards;
- driving a plurality of piles into the soil in predetermined respective locations to a predetermined founding depth;
- setting a formwork on the loosened soil to define the perimeter of the concrete slab to be constructed; and
- subsequently forming a concrete slab on the loose soil defined by the formwork and supported by the piles.

Advantageously, loosening the soil prior to forming the concrete slab is believed to prevent damage due to soil heave when the soil becomes wet from seepage of moisture from the surrounding soil into the soil under the slab. Preferably, the soil is loosened to a depth sufficient to raise the surface of the soil to a level which is equal to or greater than the level to which the surface would rise if the soil was to become wet. It will be appreciated that the depth of loosening required will depend on various characteristics of the soil and in some cases may be to a depth of 800 mm. while in other cases it may be 600 mm. while in others it may be as little as 200 mm. Characteristics which may be considered include swell potential of the soil, shrink potential, bearing capacity, and soil type although other characteristics may also be considered.

Preferably, the soil is loosened to a depth sufficient to raise the surface of the soil to a level which is equal to or greater than the level to which the surface would rise if the soil was to become wet. However, it is believed that the loosening of the soil places it in a form in which it can accommodate sufficient movement to avoid a damaging amount of soil heave on the slab, thus preventing cracking of the slab and any walls which may be erected on the slab. The depth of loosening required depends on the reactivity of the soil. For example, a moderately reactive soil may have a wet-to-dry change in height of 30 mm. while a highly reactive soil may have a change of 75 mm. and an extremely reactive soil may have a change of 110 mm. Thus, the depth of loosening required to achieve an increase in the level of the soil (by introducing voids into the soil) increases as the reactivity increases and might be 400 mm. for a moderately reactive soil and 800 mm. for an extremely reactive soil. It will be appreciated that irrespective of the wetness of the soil at the time of loosening, provided a depth of loosening is selected for the reactivity of the soil from a table prepared on the basis of dry soil, the loosened surface will be higher than the maximum wet height of the soil.

Although the soil may be loosened by a number of different operations, the preferred methods are ripping and/or scarifying. Typically, the founding depth to which the piles are driven would be significantly deeper than the loosening depth to which the soil is ripped, scarified, plowed, or the like although it will be appreciated that in some cases a layer of clay soil may lie directly on a layer of rock and the clay may be ripped completely through to the rock, and the piles may be found on the rock.

The method may include forming the loosened soil into a predetermined profile prior to forming the slab having high and low portions prior to forming the slab so that the slab formed thereon will have thickened portions in desired locations, for example, integrally formed beams.

In another aspect the invention resides broadly in a concrete slab constructed according to the method previously described.

In another aspect the invention resides broadly in a building including a concrete slab constructed according to the method previously described.

BRIEF DESCRIPTION OF THE SEVERAL VIEWS OF THE DRAWINGS

In order that the invention may be more clearly understood and put into practical effect, reference will now be made to the accompanying drawings wherein.

DETAILED DESCRIPTION OF THE INVENTION

Figure 1:
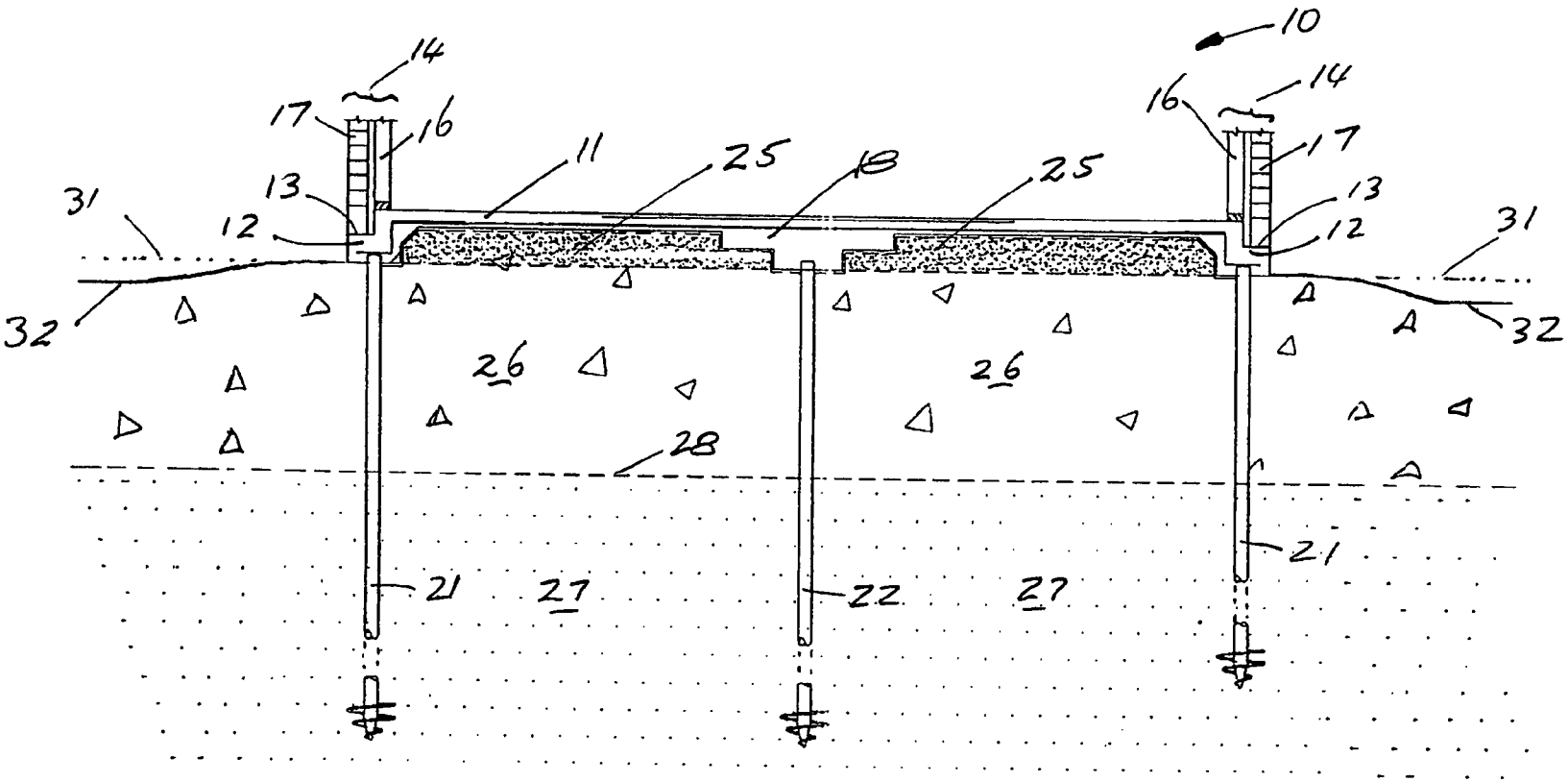
FIG. 1 is a cross-sectional elevation of part of a dwelling house having a concrete slab floor constructed according to the invention.

The dwelling house 10 illustrated in part in FIG. 1 has a reinforced concrete slab floor 11 with an integrally formed edge beam 12 extending around the perimeter and a set-down 13 integrally formed with the edge beam. An external wall 14 extends about the perimeter of the wall and has an inner timber frame 16 upstanding from the slab and a brick veneer 17 upstanding from the set-down in a known manner. The slab also has intermediate integrally formed beams or drop panels 18, and reinforcing bars and mesh are arranged in a typically known manner.

Figure 2:
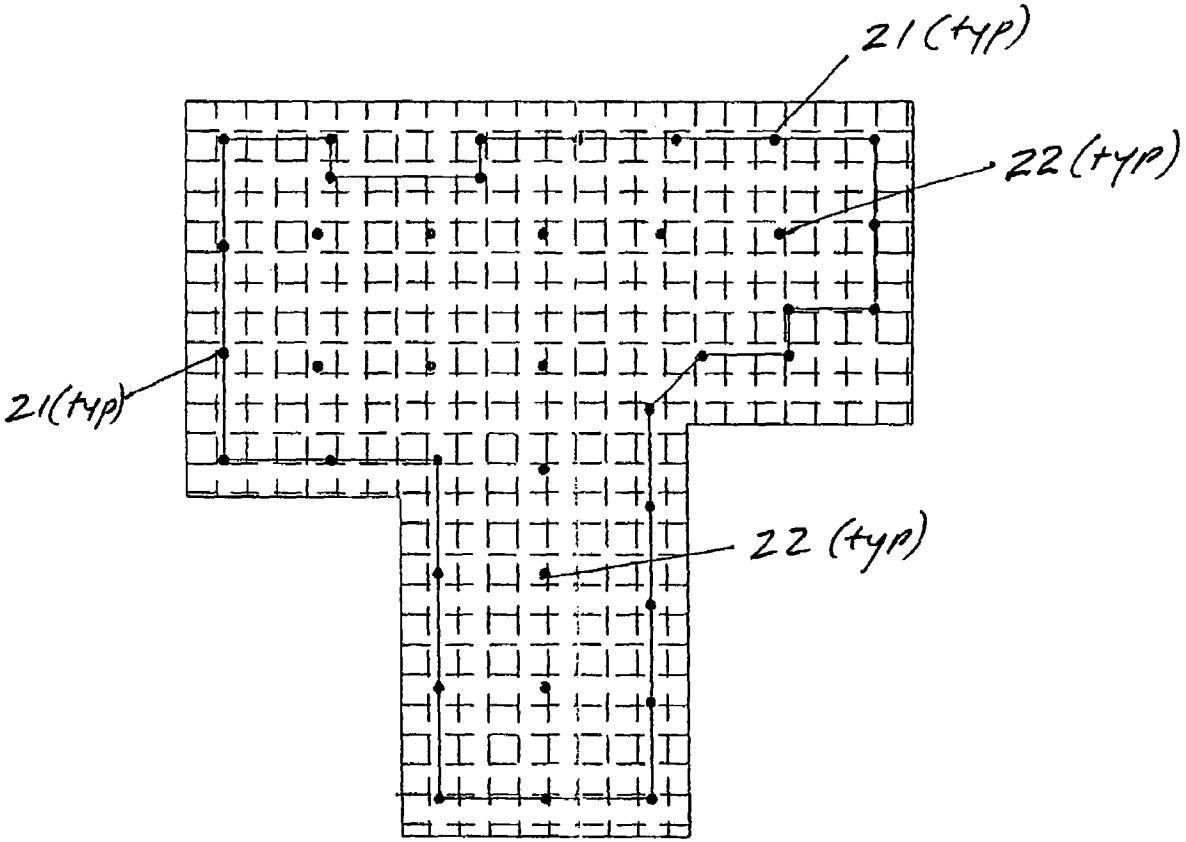
FIG. 2 is a ripping plan for the site of a dwelling house.

The slab is supported by a plurality of screw piles 21 which are spaced around the perimeter under the edge beam as well as a plurality of internal screw piles 22 which are set out in a grid-like array as more clearly shown in FIG. 2 under the slab with a beam or drop panel 18 resting on each internal pile.

As can be seen in FIG. 1, the natural ground at the site has a layer of unstable heavy clay soil 26 beneath which is a layer of stable soil 27, the boundary between the two strata being shown by a dashed line 28. Although the layer of clay soil is about 1.2 m. deep, only the upper 600 mm. is seasonally affected significantly (except in very rare occasions) by wet and dry weather during which it expands or contracts.

As can been seen in FIG. 1, the slab between the edge beam and the intermediate beams or drop panels is formed on loose fill 25 which has been introduced on top of the natural soil. However, prior to setting the perimeter formwork, driving the screw piles, or placing the loose fill, the seasonally affected portion of the natural soil has been loosened to a depth of about 600 mm. by ripping and/or scarifying in accordance with the pattern shown in FIG. 2. As FIG. 2 indicates, ripping and/or scarifying is carried out in two directions with the rippers or tines spaced apart at 400 mm. intervals. The soil is loosened in this manner up to a distance of about 1.0 m. beyond the perimeter of the house. The ripping and scarifying expands the soil upwards by introducing air pockets throughout the soil such that the upper surface is raised to a level 31 which is significantly higher than the natural ground level 32.

Figure 3:
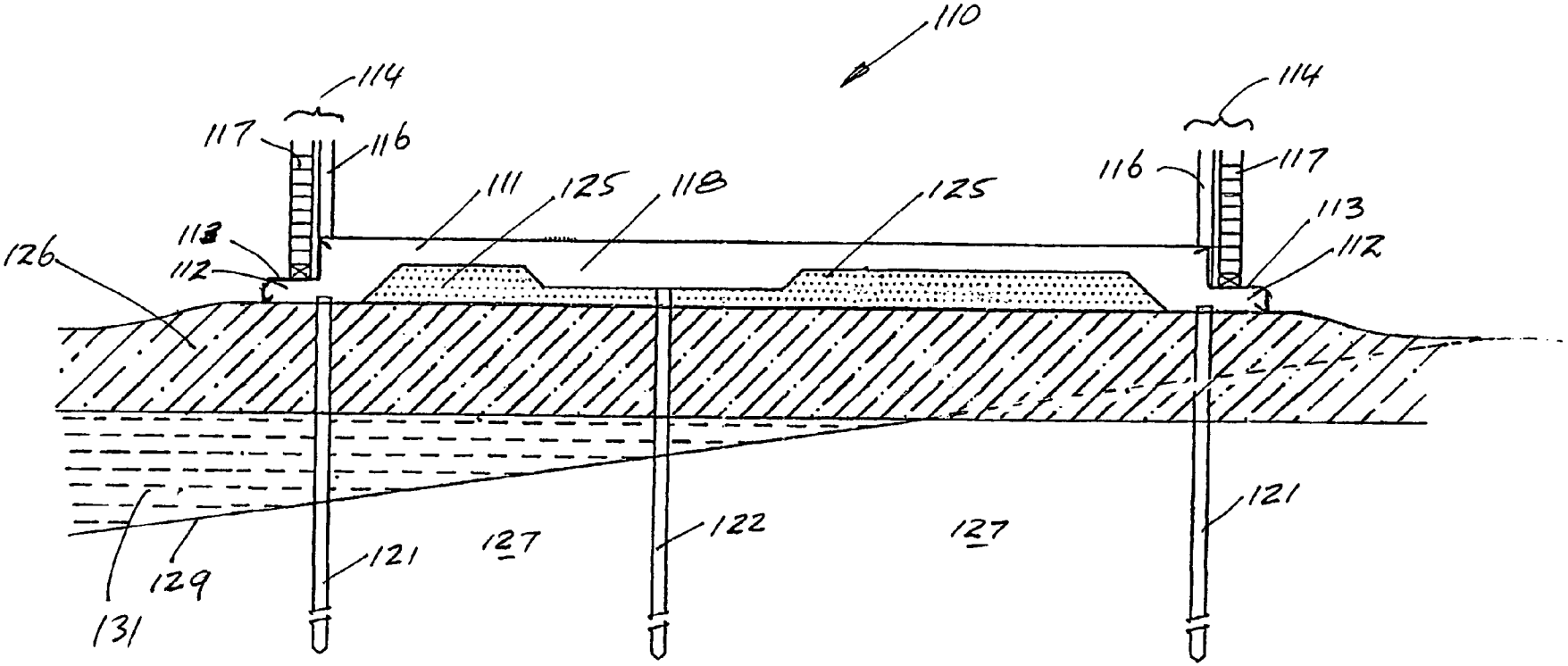
FIG. 3 is a cross-sectional elevation of part of another dwelling house having a concrete slab floor constructed according to the invention.

The house 110 illustrated in part in FIG. 3 is constructed in much the same manner as the house illustrated in FIG. 1, and corresponding numbers are used to reference corresponding items but prefaced by the numeral "1". The main difference is that the site profile was originally as shown by line 129 and two layers of fill 126 and 131 were added to level the site and bring it to the required height. The first layer 131 is a fairly unreactive layer of loam, and the second layer 126 is reactive clay which has a thickness of about 900 mm. In this case, the soil is ripped to the same depth as in FIG. 1, and the screw piles are all founded to the same depth in the stable soil 127.

While the foregoing description has been given by way of illustrative example of the invention, it will be understood that the invention may be embodied in many other forms and all such forms are deemed to fall within the broad scope and ambit of the invention as defined by the appended claims.

What is claimed is:

1. A method of constructing a concrete building slab, the method comprising the steps of:

selecting a site on which a concrete building slab is to be constructed;

loosening the soil on which the concrete building slab is to be constructed on the site to at least a predetermined loosening depth so as to expand the soil upwards to at least a level above the swell potential of the soil;

driving a plurality of piles into the soil in predetermined respective locations to a predetermined founding depth; and subsequently forming a concrete slab on the loosened soil to be supported by the piles.

2. The method according to claim 1, further comprising the step of:

setting a formwork on the loosened soil to define a perimeter of the concrete slab to be constructed before forming the concrete slab.

3. The method according to claim 2, wherein the soil is loosened to a depth sufficient to raise the surface of the soil to a level which is equal to or greater than the level to which the surface would rise if the soil were to become wet.

4. The method according to claim 2, further comprising the step of:

selecting the predetermined loosening depth by reference to one or more parameters of the soil.

5. The method according to claim 4, wherein one parameter is a swell potential of the soil.

6. The method according to claim 5, wherein the remaining parameters include a shrink potential and a bearing capacity of the soil.

7. The method according to claim 3, wherein the depth of loosening is between 200 mm. and 800 mm.

8. The method according to claim 2, wherein the loosening of the soil is achieved by ripping, scarifying and/or plowing the soil.

9. The method according to claim 2, further comprising the step of:

forming the loosened soil into a predetermined profile having high and low portions prior to forming the slab.

10. A concrete building slab constructed according to the method of claim 2.

11. A building including a concrete slab constructed according to the method of claim 2.

* * * * *